United States Patent [19]

Discavage

[11] Patent Number: 4,502,911

[45] Date of Patent: Mar. 5, 1985

[54] STRAPPING MACHINE

[75] Inventor: James L. Discavage, Brookhaven, Pa.

[73] Assignee: Cyklop International Emil Hoffman, KG, Fed. Rep. of Germany

[21] Appl. No.: 517,641

[22] Filed: Jul. 27, 1983

[51] Int. Cl.[3] ..... B30B 15/34; B65B 13/32

[52] U.S. Cl. ..... 156/499; 100/33 PB; 156/502; 156/583.1

[58] Field of Search ..... 156/157, 580, 502, 583.1, 156/499; 100/33 PB

[56] References Cited

U.S. PATENT DOCUMENTS

| | | | |
|---|---|---|---|
| 3,029,180 | 4/1962 | Laliberte | 156/502 |
| 3,783,079 | 1/1974 | Wehr | 156/502 |
| 3,914,153 | 10/1975 | Sato | 100/33 PB |
| 4,288,270 | 9/1981 | Mossell | 156/502 |
| 4,450,032 | 5/1984 | Wehr | 156/580 |

*Primary Examiner*—Michael Wityshyn

*Attorney, Agent, or Firm*—Lipton & Famiglio

[57] ABSTRACT

An improved apparatus is disclosed in which a tensioned plastic strap loop is placed about an article. The invention includes an improved rear guide. The guide is connected to the rear gripper so that it moves with it. The rear guide has a pair of forward and a pair of rear guide members. The forward members are shorter than the rear ones. The forward seal guide members are located so that they are in the middle of the seal region and thus prevent lateral movement of the overlapped strap ends when the heat seal blade is inserted and withdrawn from between them.

8 Claims, 9 Drawing Figures

2

STRAPPING MACHINE

BACKGROUND OF THE INVENTION

This invention relates generally to apparatus or machine which place a tensioned loop about an article. The invention is particularly directed to the manner in which the strap is guided through the passageway or strap channel of such apparatus.

In typical strap feed and tension mechanisms of known strapping apparatus or machines, strap from a supply is engaged by two or more wheels, at least one of which is positively driven, as by a reversible motor, to effect strap advancement and retraction. With such mechanisms, motion is transmitted to the strap simply by nipping the strap between rolls, or by the traction exerted on the strap by substantial portions of the rolls' surfaces, or by both nipping the strap and exerting traction along significant lengths thereof. U.S. Pat. No. Re.27,744 describes a strap feed and tension mechanism or strap drive assembly which is illustrative of those employed in conventional strapping machines.

Many prior art strapping machines secure the opposing overlapped ends by welding or heat sealing them. This is accomplished by inserting a hot heat seal blade between the ends until the plastic becomes molten on the opposing surfaces. The blade is then withdrawn and the overlapped ends pressed together until the plastic solidifies thereby sealing the ends together.

Although the performance of modern strapping apparatus has shown constant improvement, they are stil not entirely satisfactory. Apparatus which use plastic strap still have abrasion problems caused by the strap impacting the various components of the apparatus as it passes through the strap passageway. The strap is also caused to abrade in those cases where it is driven by rollers operating at different speeds. Such abraded strap may be weakened by having its molecular orientation disturbed, its surface marred to such an extent as to make subsequent use of the strap difficult, and by creating dust particles which may interfere with the strap's passage through the machine, either by blocking the passage or to cause portions of the machine to malfunction.

Some of these problems have been recognized. For example, the problem with abraded strap in a particular feed and tension mechanism by U.S. Pat. No. 4,328,742, issued to J. L. Discavage. This patent teaches a feed and tension mechanism actuated by a reversible drive mechanism. The feed and tension mechanism is of the type having two wheels of equal diameter, one of which is driven, for feeding and tensioning the strap. Abrasion of the strap is minimized by placing meshing gears as flanges on the two wheels, which act as guides and which rotate with the wheels. Accordingly, the two wheels rotate at the same speed.

Another problem with prior art machines is that the region of the seal is less than optimum in that the ends of the straps are sometimes skewed, i.e. not parallel to one another. This results in a reduced seal area and hence reduced strength. Additionally, the ends occasionally are not fully overlapped thus also reducing the seal area and the strength of the seal. In some cases the strap ends are in such undesirable positions before the heat seal blade is used and in other cases properly aligned strap ends are missaligned by the insertion of the blade, or more commonly, by its withdrawal.

Abrasion and jams tend to occur in strapping apparatus at various points along the strap passage. One such point is between the strap drive assembly and the forward guide, and between the forward guide and the forward gripper, as well as within the forward guide itself. Another problem with prior art strapping apparatus is that some of those which are adapted to use straps of different widths have removable guides therefore. Not only is the extra guide an additional expense, but time is required to change the guides.

Some front guides, located between the drive mechanism and seal mechanism, of the prior art, have been laterally adjustable through the use of shims so as to obtain the proper clearance between the strap and guide. However, such guides have had only one side thereof adjustable with respect to the body of the guide. Not only has this been time consuming, but it has resulted in the shifting of the strap from the passage centerline, when the prior art guide was adjusted. Additionally, prior art guides have had to be removed for cleaning, a time consuming and, therefore, costly step.

SUMMARY OF THE INVENTION

Accordingly, a primary object of the invention is to provide an improved strapping apparatus for applying tensioned strap loops about articles.

An object of the present invention is to provide a strapping machine which provides a seal region having fully overlapped strap ends which are parallel to one another.

It is another object of the present invention to provide a strapping machine wherein insertion or withdrawal of the heat seal blade will not cause misalignment of the overlapped strap ends.

Another object of the present invention is to provide a strapping apparatus having an improved passageway therethrough, which permits the strap to easily pass therethrough.

Another object of the present invention is to provide a guide, located between the strap drive assembly and the seal assembly, which will minimize abrasion and jamming of the strap.

Still another object of the present invention to provide such a guide which is adjustable so that the proper width of the strap passage may be easily obtained and so that straps of different widths may be accommodated.

Still another object of the present invention is to provide a guide which cooperates with the movable front gripper so as to avoid the jamming of the strap thereagainst.

These and other objects are accomplished in accordance with the present invention by providing an improved guide means for the strap passageway. An improved front guide is located between the strap drive assembly and the seal assembly. The front guide has lower and upper passageways. The lower passageway guides the strap between the strap drive assembly and seal assembly while the upper passageway guides the strap from the article to the seal assembly.

The forward end of the front guide is pivotally connected to feed nip wheel of the strap drive assembly. The nip wheel is connected to a pivotable rocker arm which forces the nip wheel to press the strap against a drive wheel. By pivotally connecting the front guide to the feed nip, a substantially constant gap is provided between the front guide and the nip and drive wheels when they are engaged.

The opening of the forward end of the lower passageway is substantially wider and higher than the dimensions of the strap which is to be passed through it. The width and height of the passageway narrow from the opening to an area of contant width and height. The side pieces of the guide which form the sides of the lower passageway are easily adjustable so that the proper distance between the opposing side pieces may be obtained. The adjustability also permits straps of different widths to be accommodated without the requirement that another front guide having a different width be used.

These features avoid the problem of strap jamming and abrasion at the interface between the strap drive assembly and the front guide, as well as within the guide itself.

The rear end of the front guide rests upon the front gripper. The front gripper has a hole therein which forms part of the strap passageway downstream from the front gripper. The top portion of the front gripper grips the lead end of the strap by moving upward and pressing it against an anvil. The front guide rests upon a surface on the front gripper which also forms a portion of the hole and passageway. Thus, the rear end of the front guide moves up and down with the front gripper since it is pivotally connected to the feed nip. In this manner, proper alignment between the passage through the front gripper and front guide is maintained, thereby avoiding jamming and minimizing abrasion.

The upper passageway of the front guide guides the lead end of the strap between the front gripper and anvil after it has been passed about the article. In the preferred embodiment of the invention the members which form the side walls of the lower passageway also form the side walls of the upper passageway, thus, the distance between them is also adjustable so that straps of varying sizes may be used without the requirement the front guide be changed.

The front guide may be substantially raised at its rear end for cleaning purposes due to the fact that it is pivotally mounted to the feed nip wheel. Thus, removal of the guide for that purpose is not necessary.

The invention includes a rear guide which has a forward pair of guide members and a pair of rear guide members. The rear members are higher than the forward pair so that they may guide the strap ends before the forward ones are required. The rear end of the rear guide is secured to the rear gripper so that it moves vertically with it. The forward portion of the guide fits in a slot in the cutter/platten block in the middle of the seal region. The rear guide and the cutter/platten block can move independently of one another. The heat seal blade has a slot in it so that the blade may be inserted between the strap ends so that the forward members fit within the blade slot. The forward members of the guide prevent lateral movement of the strap ends as the blade is inserted or withdrawn between them.

The feed wheel of the strapping apparatus' drive assembly includes flanges on both of its sides. The feed and tension nip wheels fit between the flanges when they are pressing the strap against the feed wheel. The flanges prevent abrasion and maintain lateral movement of the strap within an appropriate range before it is to be received by the front guide.

BRIEF DESCRIPTION OF THE DRAWINGS

The construction of the preferred embodiment as well as further objects and advantages of the invention will become further apparent from the following specification when considered with the accompanying drawings in which like numerals refer to like parts wherein.

DESCRIPTION OF THE PREFERRED EMBODIMENT

Figure 1A:
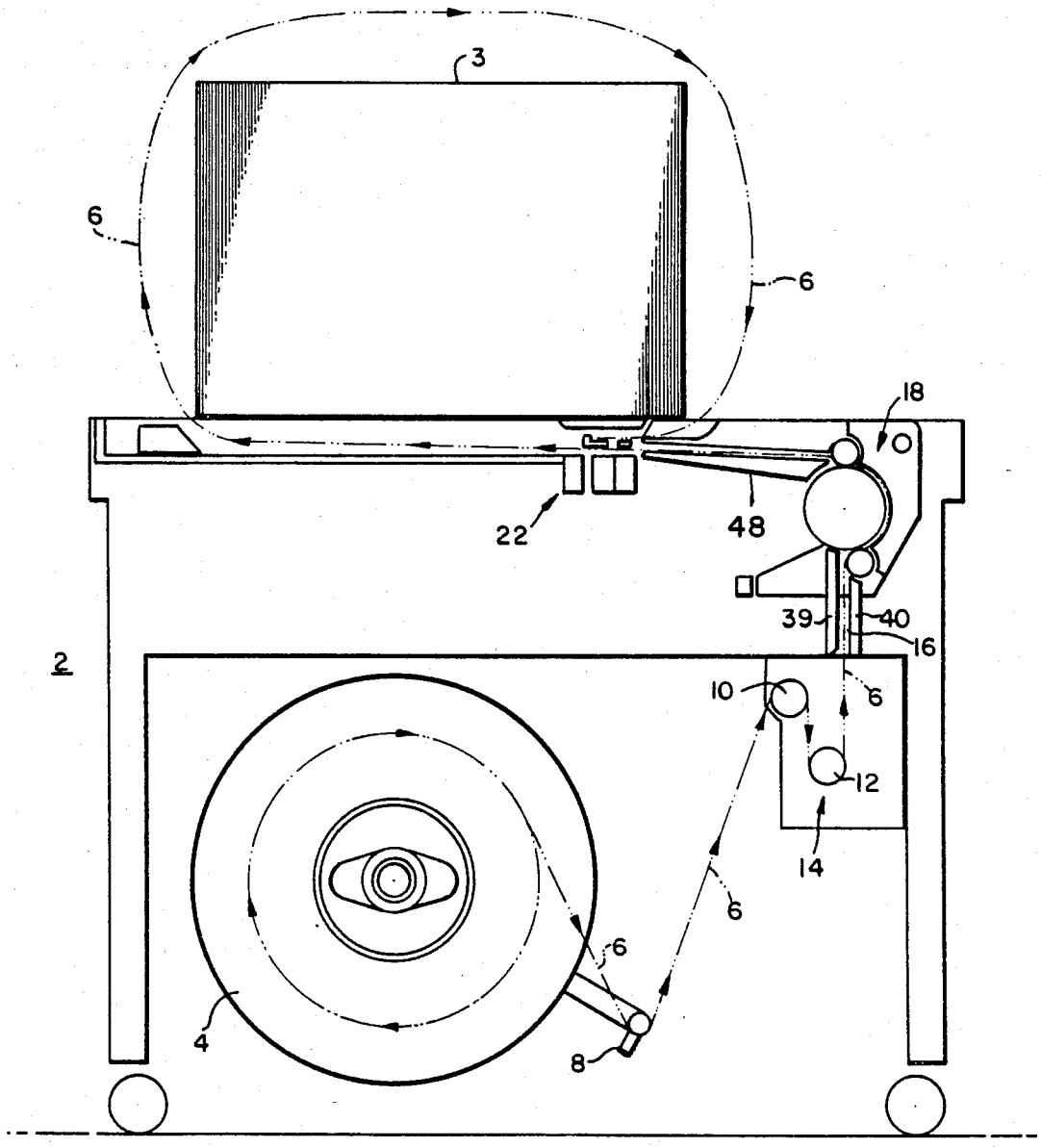
FIG. 1*a* is a front perspective view of the strapping apparatus.
Figure 1B:
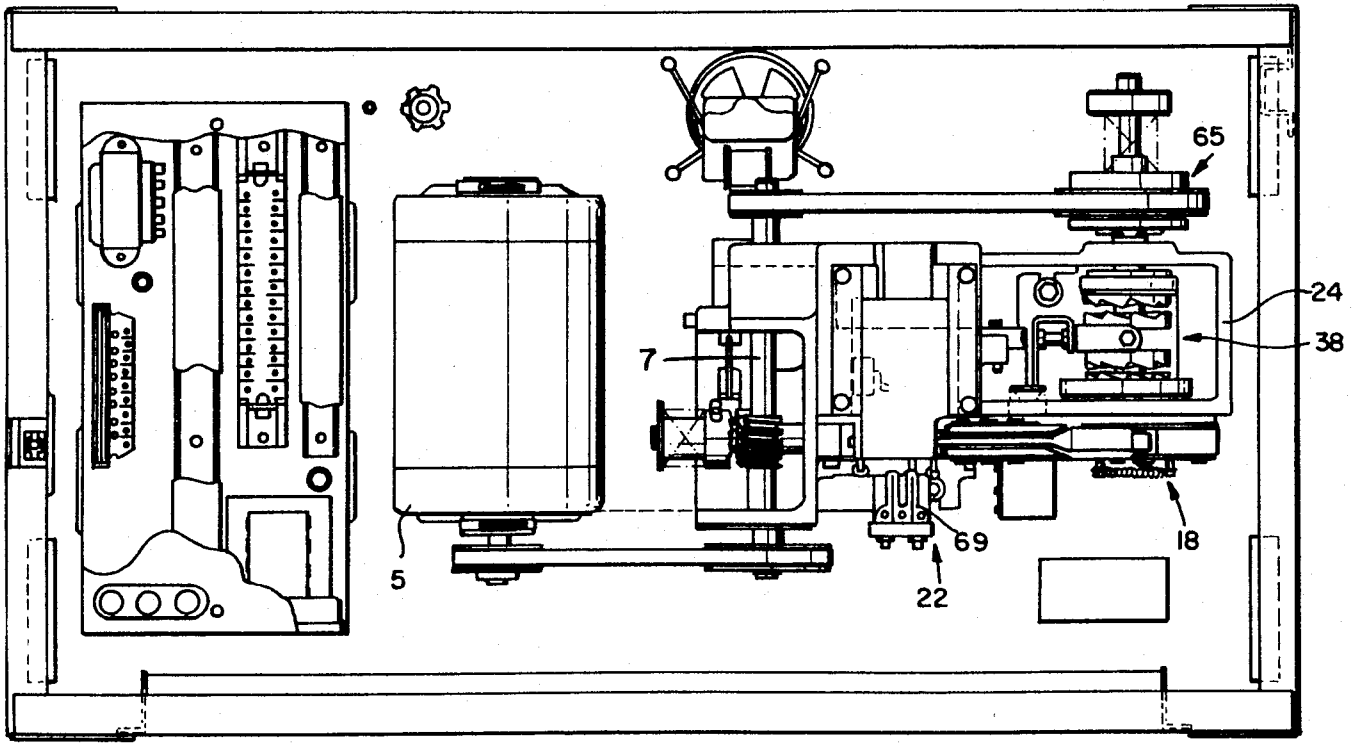
FIG. 1*b* is a top view of the strapping apparatus shown in FIG. 1*a*.

The strapping apparatus 2 of the present invention is shown in FIGS. 1*a* and 1*b*. In FIG. 1*a* an article 3 is shown, which is to have a tensioned loop placed about it. The feed roll or dispenser 4 is shown having polypropylene strap 6 wound thereon. The strap is initially fed about a brake arm roll 8 and rollers 10 and 12 of an accumulator assembly 14. The strap is then fed into a guide channel 16 of the strap drive assembly 18. After passing through the strap drive assembly 18, the strap 6 passes through a bottom passage of the front guide assembly 48 through the seal assembly 22, about an article, through a top passage of the front guide assembly 48, and back to the seal assembly 22.

The strap drive assembly 18 feeds and tensions the strap about the article. The seal assembly, which includes means for gripping the strap, maintains tension in the loop, cuts the strap, and seals the overlapped ends of the loop through heat sealing. A motor 5 drives a shaft 7 which, as will hereinafter be described, drives the strap drive assembly 18 and the seal assembly 22.

Figure 2:
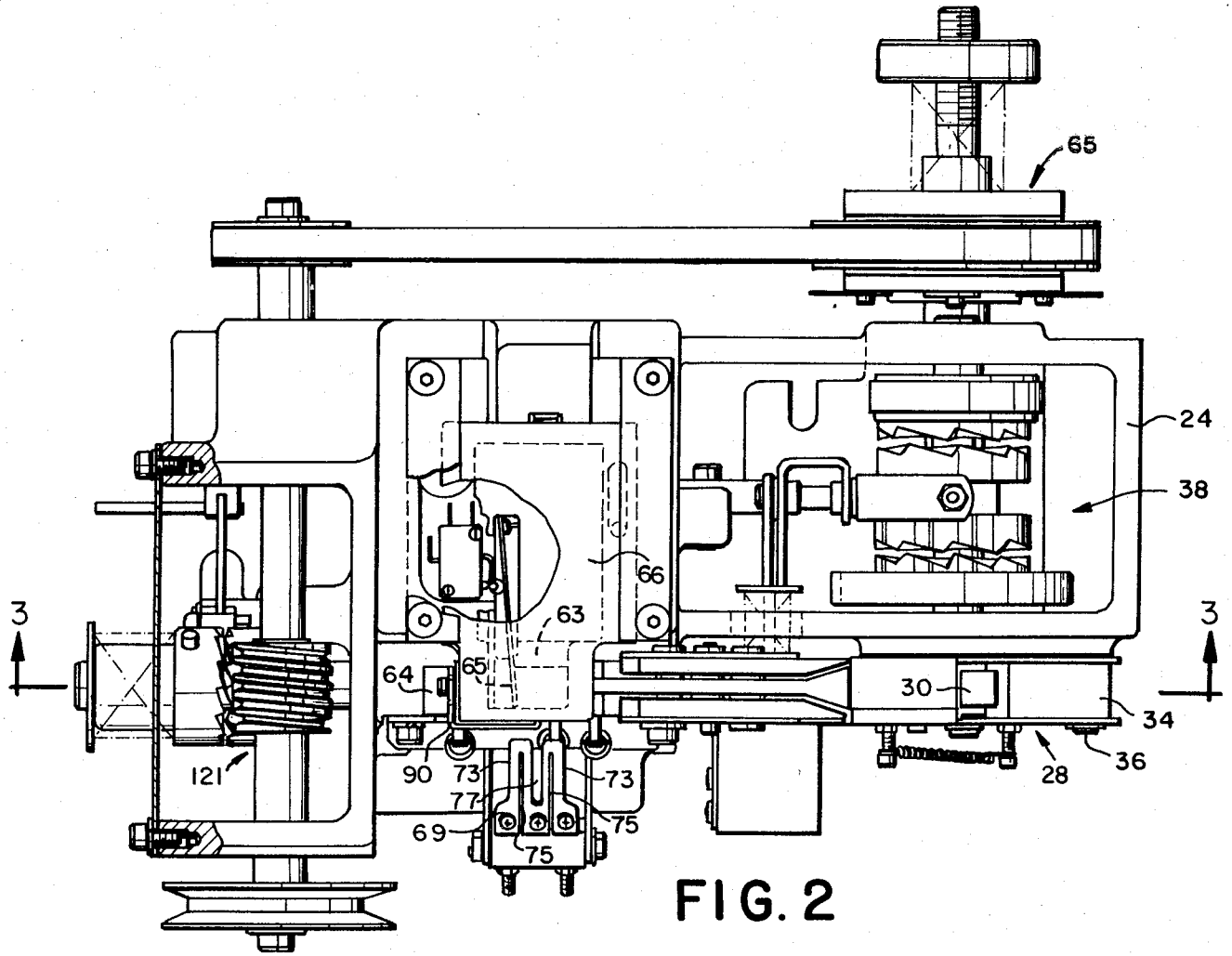
FIG. 2 is a top view of a portion of the apparatus shown in FIG. 1.
Figure 3:
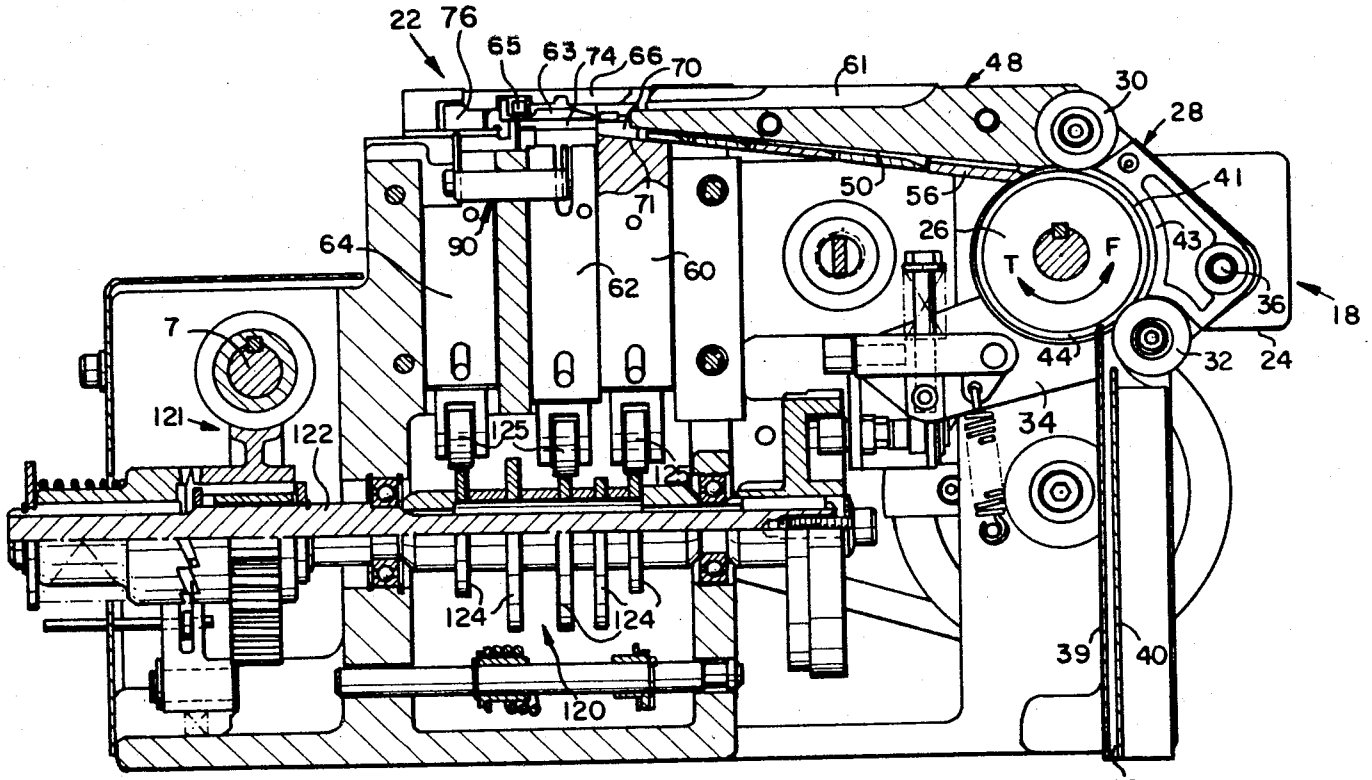
FIG. 3 is a side section view taken along line 3—3 in FIG. 2.

As may also be seen in FIGS. 2 and 3, the strap drive assembly 18 is shown connected to a frame 24. The strap drive assembly 18 includes a drive wheel 26 and a nip assembly 28. The nip assembly 28 includes a feed nip 30, a tension nip 32, and a guide block 43. Both nips 30 and 32 are mounted to a rocker arm 34 which is pivotally connected to the frame 24 at pivot 36. The rocker arm is actuated or rotated by a cam assembly, as will hereinafter be described.

Wheel 26 rotates in the direction labeled "F" for feeding the strap 6 about an article, and in the direction indicated by "T" when the strap is being tensioned. There are any one of a number of different ways in which the wheel 26 may be reversibly driven. One such way is to connect the wheel to a reversible air motor. In the preferred embodiment of the invention shown herein, the unidirectional electric motor is connected to a reversible clutch assembly 38 which is used to reverse direction of rotation of wheel 26. The passage 16 which leads the strap to the drive mechanism is formed by guides 39 and 40. The strap passageway 41 in the drive mechanism 18 is formed by guide block 43 in the nip assembly 28 and drive wheel 26. The drive wheel 26 includes a pair of flanges 44, only one of which is showing, which act as guides and prevent excessive lateral movement of strap 6.

The angle formed by the centers of the feed nip 30, drive wheel 26, and tension nip 32 is in excess of one hundred degrees, and for the preferred embodiment is approximately one hundred and twenty degrees. The feed wheel surface has been coated with urethane rubber, or any other suitable elastomer compound, so as to provide optimum frictional engagement between the polypropylene strap and drive wheel 26. The friction engagement is further optimized by the one hundred and twenty degree region of contact between the drive wheel and the strap. This enables a drive mechanism having a single movable tension nip to achieve high tension.

A front guide assembly 48 passes the strap from the drive assembly 18 to the grip and seal mechanism 22. The front guide 48 is pivotally mounted to the nip assembly 28 so that it has the same pivot point as feed nip 30. This permits the guide to maintain proper alignment with nip assembly 28 of drive assembly 18. As may be seen in FIGS. 4–7 front guide 48 has a lower passage 50 through which strap 6 passes upon its exit from drive mechanism 18. Front guide 48 is constructed of center section 53 and side pieces 52 and 54 which are connected together by screw 49. The bottom of center section 53 forms the top of passage 50. Rotation of screw 49 causes the two side pieces to move laterally with respect to center section 53 and one another thereby permitting the width of passage 50 to be adjusted. This not only permits proper adjustment of the passage for a strap of a particular width, but also permits straps of different widths to be accommodated by this machine.

The center section 53 extends the entire length of front guide 48 and is constructed of two sections **53*a* and 53*b*. Section 53*a* is tapered and sandwiched between sidepieces 52 and 54. Forward of the side pieces section 53 includes both sections 53*a* and 53*b* which are held together by bolt assembly 55**.

Figure 5:
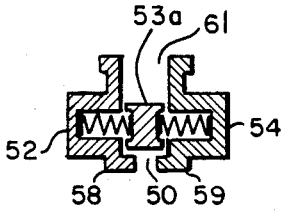
FIG. 5 is a view take along line 5—5 in FIG. 4.
Figure 6:
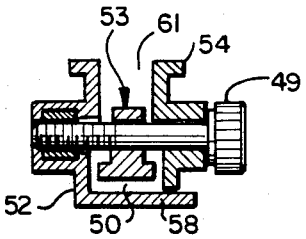
FIG. 6 is a view take along line 6—6 in FIG. 4.
Figure 7:
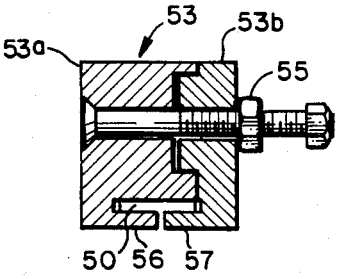
FIG. 7 is a view take along line 7—7 in FIG. 4.

The passageway 50 is formed by lips 56 and 57 found on sections **53*a* and 53*b* respectively, and lips 58 and 59 found on sidepieces 52 and 54, respectively. Lips 58 and 59 form intermeshing fingers in the mid region of side pieces 52 and 54, in the preferred embodiment. However, they could maintain a constant and non-intermeshing relationship for the entire length of the sidepieces, as shown in FIG. 5**.

As will be further discussed side pieces 52, 54 and section 53 of center section **53*a* form an upper passageway or channel 61 for guiding the strap back to the seal assembly 22 after it has been looped or placed about the article. The width of channel 61 is also adjustable by virtue of the adjustability of side pieces 52 and 54** and hence is adjustable to obtain the proper clearance for a particular strap width and for different straps of different widths.

As may be seen in FIGS. 2 and 3, behind and downstream from the front gripper is the seal assembly 22 which includes a front gripper 60, a cutter/platen block 62, a tongue 63, and a rear gripper 64. It also includes an anvil 66 and a heat seal blade 69. The strap, upon leaving the rear end of the front guide, passes through a hole 70 in front gripper 60, through a space or gap 74 between cutter/platen block 62 and tongue 63, and a space or gap 76 between rear gripper 64 and anvil 66. As will be further discussed the grippers which are raised and lowered hold the strap by forcing it against the anvil.

Figure 4:
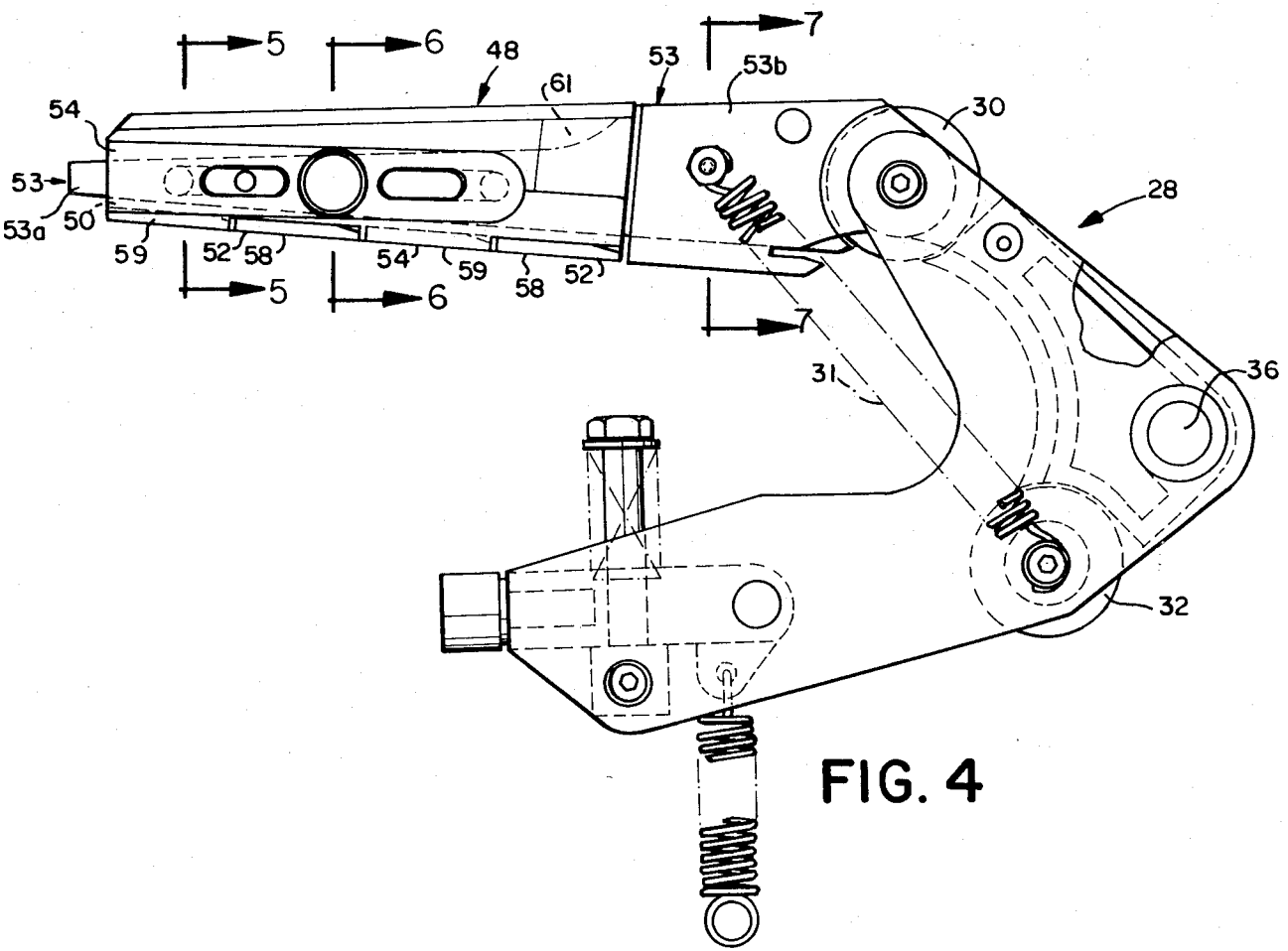
FIG. 4 is an enlarged side view of the front guide and nip assembly shown in FIG. 3.

The rear end of front guide assembly 48 rests upon front gripper 60. The front gripper has a hole 70 in it which permits the strap to pass therethrough. A surface 71 forms the bottom of the hole and is the surface upon which the front guide rests. As the front gripper is raised and lowered during operation of the strapping machine, the front guide pivots about feed nip 30. Thus, the guide always maintains proper orientation with hole 70, which forms a portion of the strap passageway. This minimizes jamming of the strap against the front gripper and abrasion of the strap against the sides of hole 70. A spring 31, as may be seen in FIG. 4, is connected to front guide assembly 48 and nip assembly 28 to keep the front guide resting on front gripper 60.

After strap 6 has passed rear gripper 64, during the feed cycle, it is fed about the article and guided into a channel 61 in the top of front guide 48. Strap 6, in the preferred embodiment, is manually fed about the article. As previously indicated, such machines are known as semi-automatic strapping machines. Well known and conventional yokes may be also used to form an automatic strapping machine which does not require manual feeding of the strap about the aricle.

The lead end of strap 6 is inserted in groove or channel 61 until its end is positioned between the top of front gripper 60 and anvil 66, as well as tongue 63 and the anvil, whereupon the front gripper is automatically raised, clamping the strap between the front gripper and the anvil. As may be seen in FIGS. 2 and 3 the proper positioning of the strap between the anvil and tongue 63 is detected by the movement of a switch 65.

Figure 8:
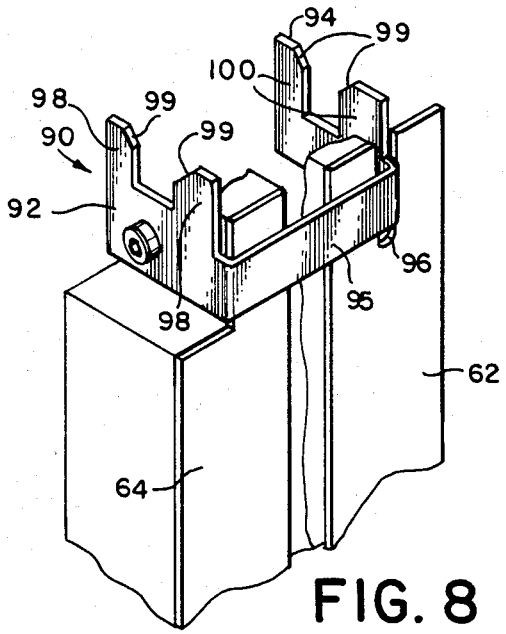
FIG. 8 is a perspective view of the rear guide shown in FIG. 3.

Referring now primarily to FIGS. 3 and 8 a rear guide assembly 90 is, at its rear end 92, shown connected to rear gripper 64 by a screw. The forward end 94 of rear guide assembly 90 is placed in a slot 96 of cutter/platen block 62. Rear end 92 of the rear guide assembly 90 has upwardly projecting rear guides or rear guide members 98 which are taller than a similar pair of upwardly projecting seal guides or seal guide members 100 of forward end 94. Ends 92 and 94 are connected by a side member 95.

The positioning of the forward end 94 in slot 96 of the cutter/platen block permits the rear gripper and the cutter/platen block to move independently of one another. It also permits the positioning of guide members 100 in the middle of the seal region, as viewed from a lateral perspective.

The greater height of guides 98 enable them to guide the strap when the rear gripper 64 is raised to an intermediate position. The full raising of rear gripper 64 also raises guides 100 causing them to provide proper alignment when blade 69 is inserted and withdrawn. Thus, guides 100 provide proper orientation of the strap in the middle of the seal region during sealing. Guides 98 and 100 have inwardly sloping surfaces 99 which act to force the strap into proper alignment.

Rear guide 90 causes the upper and lower strap ends to be completely overlapped in the seal region and to have their center lines parallel thus providing proper alignment of the strap ends. This results in a stronger seal and one that is not placed under undue stress concentrations due to angular misalignment.

The seal is formed between the lead end of the strap secured between anvil 66 and front gripper 60 and the lower supply end of the strap secured between rear gripper 64 and anvil 66. The two ends are initially separated by tongue 63. As tongue 63 is withdrawn blade 69 is inserted between the overlapped ends. As may be seen in FIG. 2 blade 69, which is electrically conductive, is formed by a pair of projecting members 73, each of which have a slot 75 therein. A gap 77 is formed between blade members 73. As the blade is inserted between the overlapped strap ends guide members 100 of rear guide 90 are positioned within slot 77.

The electric motor 5 also drives a cam assembly 120. As may be seen in FIGS. 2 and 3 shaft 7 rotates a cam shaft 122 through a worm gear assembly 121. Appropriately shaped cams 124 actuate cam followers 125 which move the grippers, tongue, cutter/platen, blade, and the like. The cam assembly shown is used in the preferred embodiment of the invention, but it is to be understood that other designs that are well within the state of the art may be used with equal success.

As previously indicated, the strapping apparatus of the present invention is initially threaded by placing the lead end of strap 6 in the passage formed by guides 39 and 40, about drive wheel 26, through passage 41 formed by the drive wheel and nip assembly 28, and through passage 50 in forward guide 48. As previously indicated, the lead end of strap 6 is passed through hole 70 in front gripper 60, over the cutter/platen block 62, and over rear guide 64. The lead end of strap 6 is then either manually or automatically placed about the article and guided into channel 61 in front guide 48, placed between and past front gripper 60 and anvil 66 and over tongue 63. The projection of the end of the strap past front gripper 60 actuates tongue switch 65.

Actuation of tongue switch 65 commences rotation of cam assembly 120. This in turn causes the front gripper to raise, thereby securing the lead end of the strap between the front gripper 60 and anvil 66. In addition, the rear gripper 64 with rear guide 90 connected to it is raised to an intermediate position. This causes the upward projecting guide members 98 of the rear end 92 of the guide 90 to properly align strap 6.

The overlapped, untensioned strap ends are now properly aligned. The lead end of the strap is properly positioned by the upper channel 61 of the front guide and secured by front gripper 60. The feed end of the strap is properly positioned by guides 98 of the partially raised rear gripper 64 and lower passage 50 of front guide 48.

The nip assembly 28 is caused to rotate by cam assembly 120 so that the tension nip engages strap 6 between it and wheel 26, while at the same time withdrawing feed nip 30 from the wheel. The cam assembly also causes drive wheel 26 to rotate as indicated by arrow T, so as to place the strap in tension. The cam assembly actuates the reversible clutch assembly 38 which drives drive wheel 26. Tongue 63 is then withdrawn.

Tensioning continues until a predetermined degree of tension in the strap has been achieved, as indicated by slippage in a slip clutch assembly 65. Through cam assembly 120, rear gripper 64 is fully raised, securing strap 6 between it and anvil 66. The lead end of strap 6 is now positioned above a tensioned portion of strap 6 providing an overlapped region, including a region area where the lead end is separated from the portion of strap 6 which it overlaps.

Once the tension in the loop has been secured as a result of gripper 64 having been fully raised, cam assembly 120 causes the reversible clutch 38 to shift to a neutral position. Nip assembly 28 is relaxed so as to permit withdrawal of tension nip 32 from drive wheel 26.

As rear gripper 64 was completely raised, rear guide 90 was also raised. This caused upward projecting guides 100 of guide 90 to be raised also to appropriately maintain proper alignment of the overlapped strap ends during insertion and withdrawal of blade 69. Cam assembly 120 then causes insertion of heat seal blade 69 between the overlapped portions of strap 6. The overlapped portions are now in a fully overlapped and parallel relationship due to the cooperation between forward guide 48 and rear guide 90.

The cutter/platen block 62 is then caused to be raised by cam assembly 120. As it is raised, it severs the lower strap at the upper rear portion of passage 70 through front gripper 60. Subsequent to cutting, the upper surface of the platen block 62 is caused to apply light pressure to the sandwich formed by the overlapped strap portions and the heat seal blade 69 positioned between them. The blade 69 is then retracted from between the overlapped strap portions. The withdrawal of the blade does not cause misalignment of the molten seal region due to guides 100 of rear guide 90. Upon removal of blade 69, the platen is caused to rise again to force the opposing molten surfaces of the strap together, and maintains them under pressure until the weld solidifies.

Then simultaneously, the front gripper 60 and platen 62 are fully lowered while rear gripper 64 is lowered to an intermediate position, thereby permitting guide members 98 of rear guide 90 to still engage strap 6 so that the anvil may be "stripped" from the package. The "stripped" anvil is then retracted from between the strap and article. The package is then removed and the anvil is extended, along with the tongue, and the rear gripper is fully lowered. A predetermined length of strap is fed so that it may be grabbed by an operator to place about another article. The machine is thus recycled so as to permit commencement of another strapping operation.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a strapping apparatus, a seal assembly having an anvil and platen for compressing opposed strap ends against a laterally movable heat seal blade so as to form a seal, and which further includes a pair of vertically movable seal guides positioned on each side of said overlapped strap ends and within the region of said ends which are to become the seal thereby preventing lateral movement of said strap when said blade is withdrawn.

2. The apparatus of claim 1 wherein said seal guides are positioned so that they are in the middle of the seal region.

3. The apparatus of claim 1 which further includes a rear gripper for securing the strap against said anvil and which has connected thereto a pair of rear guides, said seal guides being connected to said rear gripper so as to be raised and lowered as said rear gripper is raised and lowered.

4. The apparatus of claim 3 wherein said seal guides are connected to said rear guides so as to form an integral part thereof.

5. The apparatus of claims 1, 2, 3, or 4 wherein said seal guides are positioned in a slot in said platen.

6. The apparatus of claims 1, 2, 3, or 4 wherein said blade has a slot therein for permitting it to pass about said seal guides.

7. The apparatus of claim 5 wherein said blade has a slot therein for permitting it to pass about said seal guides.

8. The apparatus of claim 4 wherein said rear guides project higher than said seal guides thereby permitting said rear guides to be active and said seal guides to be passive when said rear gripper is in an intermediate position.

* * * * *